US005139270A

United States Patent [19]

Gernhofer

[11] Patent Number: 5,139,270

[45] Date of Patent: Aug. 18, 1992

[54] NAME GAME BINGO

[76] Inventor: Margaret A. Gernhofer, 805 S. Clifton, Park Ridge, Ill. 60068

[21] Appl. No.: 709,103

[22] Filed: Jun. 3, 1991

[51] Int. Cl.[5] ..... A63F 3/06

[52] U.S. Cl. ..... 273/269

[58] Field of Search ..... 273/269, 270, 268, 273, 273/271, 236

[56] References Cited

U.S. PATENT DOCUMENTS

| | | | |
|---|---|---|---|
| 3,464,124 | 9/1969 | Lynd | 273/269 X |
| 3,665,618 | 5/1972 | Hahn | 273/270 |
| 3,822,876 | 7/1974 | Frain | 273/269 X |
| 4,169,601 | 10/1979 | Frischmann | 273/269 |
| 4,711,454 | 12/1987 | Small | 273/269 |
| 4,883,636 | 11/1989 | Fantle | 273/269 |

FOREIGN PATENT DOCUMENTS

| | | | |
|---|---|---|---|
| 491948 | 4/1953 | Canada | 273/269 |
| 1602510 | 11/1981 | Denmark | 273/269 |
| 2040822 | 2/1972 | Fed. Rep. of Germany | 273/269 |

OTHER PUBLICATIONS

"Science Bingo Series", *Science*, prior to Mar. 1976, page 187 273**269.

Travel Bingo Game advertisements, *Regal Games Catalog*, 1970, 3 pages.

*Primary Examiner*—Theatrice Brown

*Assistant Examiner*—William E. Stoll

[57] ABSTRACT

A new type of Bingo game for children wherein each of a plurality of player game cards is divided into a grid of not more than twenty-five equal areas arrayed in five rows and five columns in which are displayed in different grid areas on each card a combination of indicia consisting of not more than twenty predetermined different items each related to a single subject and at least five blank areas for designated and insertion by each player with his and the other players' names. The word "BINGO" is written above the grid columns, spaced to permit each of its letters to identify a different column. Each player plays with at least one game card. Squares, discs or chips are sequentially and randomly selected from a group of squares, discs or chips which collectively match all players' names without their columnar locations and all predetermined indicia with their columnar locations. In response to the sequential selections and announcements of the players' names and, in the case of predetermined indicia, the indicia and columnar locations, each player uses one of a supply of markers to cover the area on his game card that matches the item announced. The first player to cover five grid areas in a straight line either horizontally, vertically, or diagonally, becomes the winner and the game ends.

7 Claims, 5 Drawing Sheets

NAME GAME BINGO

BACKGROUND OF THE INVENTION (1) Field of the Invention

This invention relates to the general field of games and to the particular field of Bingo type games and the apparatus and devices used in the play of the game.

(2) Description of the Prior Art

Prior inventors have created Bingo type games of varying complexity for either instructional or entertainment purposes. Common characteristics have included i) a number of player game cards, each divided into a multiplicity of areas with each and every area identified by a unique predesignated indicium selected from a multiplicity of predetermined indicia and so placed among the areas as to cause each player game card to be different from all others; alternatively, a common characteristic has been the absence of any indicium in any of the multiplicity of areas into which the payer game cards have been divided, causing all areas to be left blank; and ii) an apparatus or device, sometimes called a key board or call board, for systematically organizing and arranging randomly selected and called indicia for the purpose of verifying player game cards as winning cards, as efficiently and quickly as the complexity of the game will permit; and iii) for each indicium used in the game, an identifying token, disc, chip, or other device used for random selection, calling and placement on the call board; and iv) a multiplicity of markers used by the individual players to identify on their individual player game cards the matching indicia previously called by the caller; and v) a caller, sometimes with assistants, who directs the game, makes the random selections, calls the indicia selected, places the called indicia on the call board, verifies winning payer game cards, and attends to the other duties incidental to the play and conduct of the game.

Prior inventions have designated and filled all areas on the player game cards with indicia or have provided for all areas of the player game cards to be left blank for insertion of indicia before the start of play. There is a need for an invention that utilizes a combination of designated areas no more than 20 in number and a number of blank areas, no fewer than 5 in number, for insertion of players' names before the start of play, causing the total of designated areas and inserted areas to equal 25 in number.

Prior inventions have the requirements that all predesignated or inserted indicia be further identified by columnar location. There is a need for an invention which has no such requirement and utilizes a combination of indicia, a portion of which are further identified by columnar location and the remaining portion of which are not identified by columnar location.

Prior inventions invented for use by children have been restricted in their design and purpose to instruction and entertainment. Some, by their complexity and formal structure, fail to hold interest and fall short of their intended objects. None have been designed for the purpose of enhancing the playing children's psychological and emotional growth by increasing self-esteem, creating a greater sense of identity, and fostering peer recognition. Ego has not been dealt with.

There is a need for children's game which is simple, informal, grasps and holds interests, and augments psychological growth.

SUMMARY

It is therefore an object of my invention to provide a simplified game by elimination of the key or call board, by limiting the rules of play, by limiting the number of player game card areas to 25, by limiting the number of predetermined and identified indicia on each player game card to no more than 20, by restricting the predetermined identified indicia to a single and familiar family of indicia related to a single enjoyable subject, and by elimination of a requirement that the columnar location of players' names on indicia be shown and announced when such indicia area selected.

It is another object to provide an informal game by using indicia subject matter which is normally enjoyed by children in an informal setting and atmosphere, by using the players' given first names in no less than five blank player game card areas and on random selection devices, and by using fewer rules of play.

It is another object to provide an interesting game by including families of indicia which are familiar and delightful to the players, by including the first names of the players, by using any unusual or handy items as markers, and by limiting the game's length to that required to complete a game having a maximum of 25 player game card areas. The risk of exceeding a player's span of attention and interest is diminished since the game is shortened by including a free center area on each player's card which is covered by a marker without being selected and announced, and by permitting a player to cover a selected and announced player's name with a marker no matter where on the player's game card the name appears.

It is another object to augment the players' psychological and emotional growth by, among other things, increasing self-esteem, creating a greater sense of identity, and fostering peer recognition, achieved by including the player's first name and no less than four other player's first names as part of the game by insertion in the blank areas on the player's game card, and by having blank squares, tokens, discs, chips, or other random selection devices identified with each player's name, one per player, and by having the player's name appearing on a selection device announced when such device has been randomly selected.

Further objects, advantages, and features of my invention will be revealed by the following specifications, embodiments, drawings, and claims of my invention.

DESCRIPTION OF THE PREFERRED EMBODIMENT(S)

Figure 1:
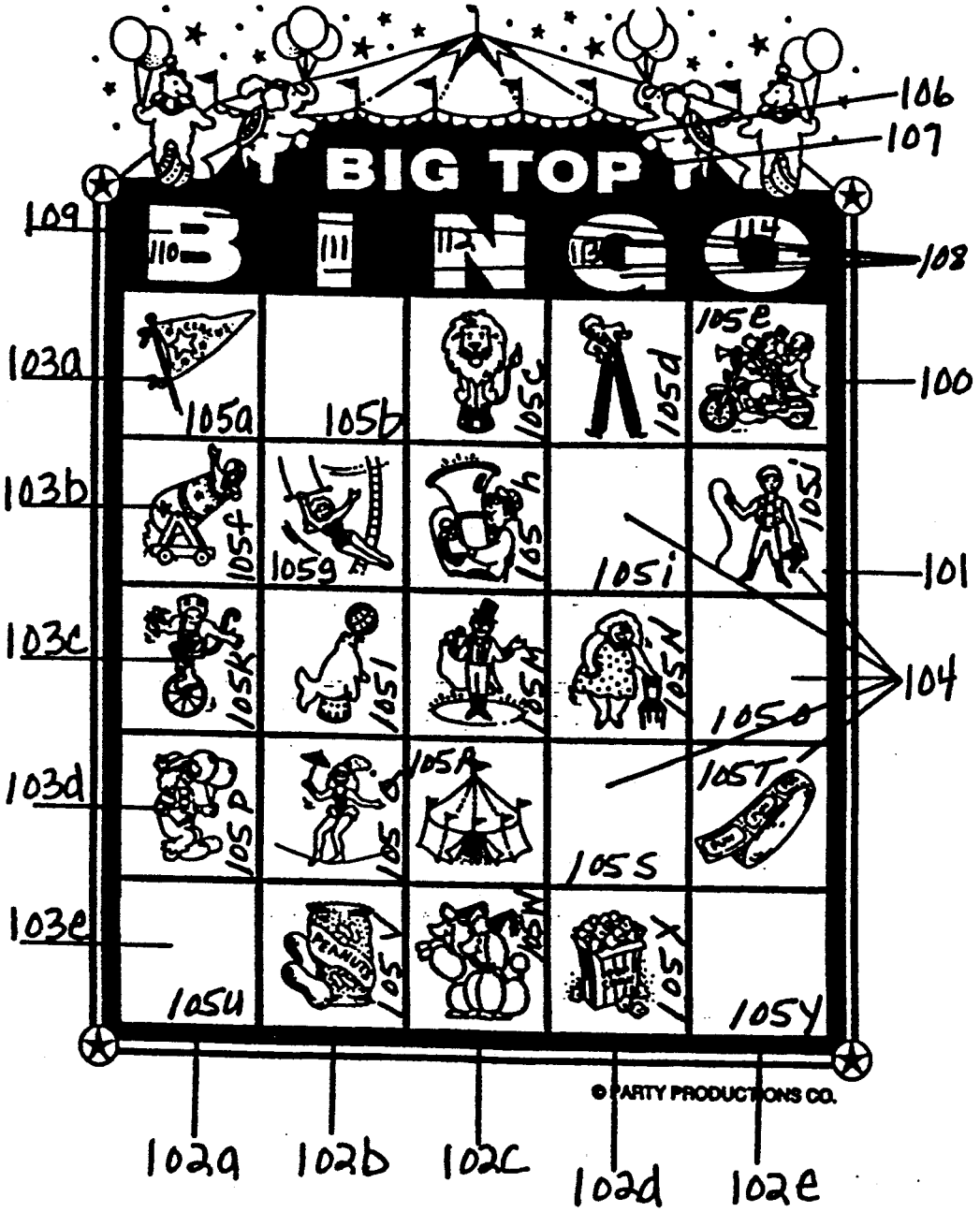
FIG. 1 illustrates a typical player game card of the "BIG TOP" edition for use with matching typical "BIG TOP" random selection squares shown in FIG. 2.

As required, detailed embodiments of the present invention are disclosed herein; however, it is to be understood that the disclosed embodiments are merely for the purpose of being exemplary of the invention which may be embodied in various forms, herein called "Editions". Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawings in greater detail, there is shown in FIG. a typical player game board 100 employed in the pay of the game. As illustrated, it consists of a material having a plane surface as its face 101 divided into five vertical columns 102*a* through 102*e* and five horizontal rows 103*a* through 103*e* creating a grid of 25 separate equal areas 104 here shown as squares 105*a* through 105*y*. The rectangular area 106 above grid 104 carries an identifying heading 108 which identifies the particular edition being played, here shown as BIG TOP 107. The word BINGO 108 in rectangle 109 is spaced over the vertical columns 102*a* through 102*e* in such a way as to cause the letter "B" 110 to be centered over column 102*a*, the letter "I" 111 to be centered over column 102*b*, the letter "N" 112 to be centered over column 102*c*, the letter "G" 113 to be centered over column 102*d*, and the letter "O" 114 to be centered over column 103*e* thereby identifying each column differently. The centermost square 105*m* is identical on all player game cards of the same "Edition" and always carries a picture or drawing of an item that is representative of the particular "Edition" being played, here shown as a Ringmaster 115, representative of "BIG TOP," synonymous with circus. In the play of the game, each player is given at least one player game card 100. Upon receipt of the player game card 100, the player will insert his name in one of the blank areas 105*b* 105*i* 105*o* 105*s* 105*y* and one of the other players' names in each of the remaining the blank areas 105*b* 105*i* 105*o* 105*s* 105*y*.

Figure 2:
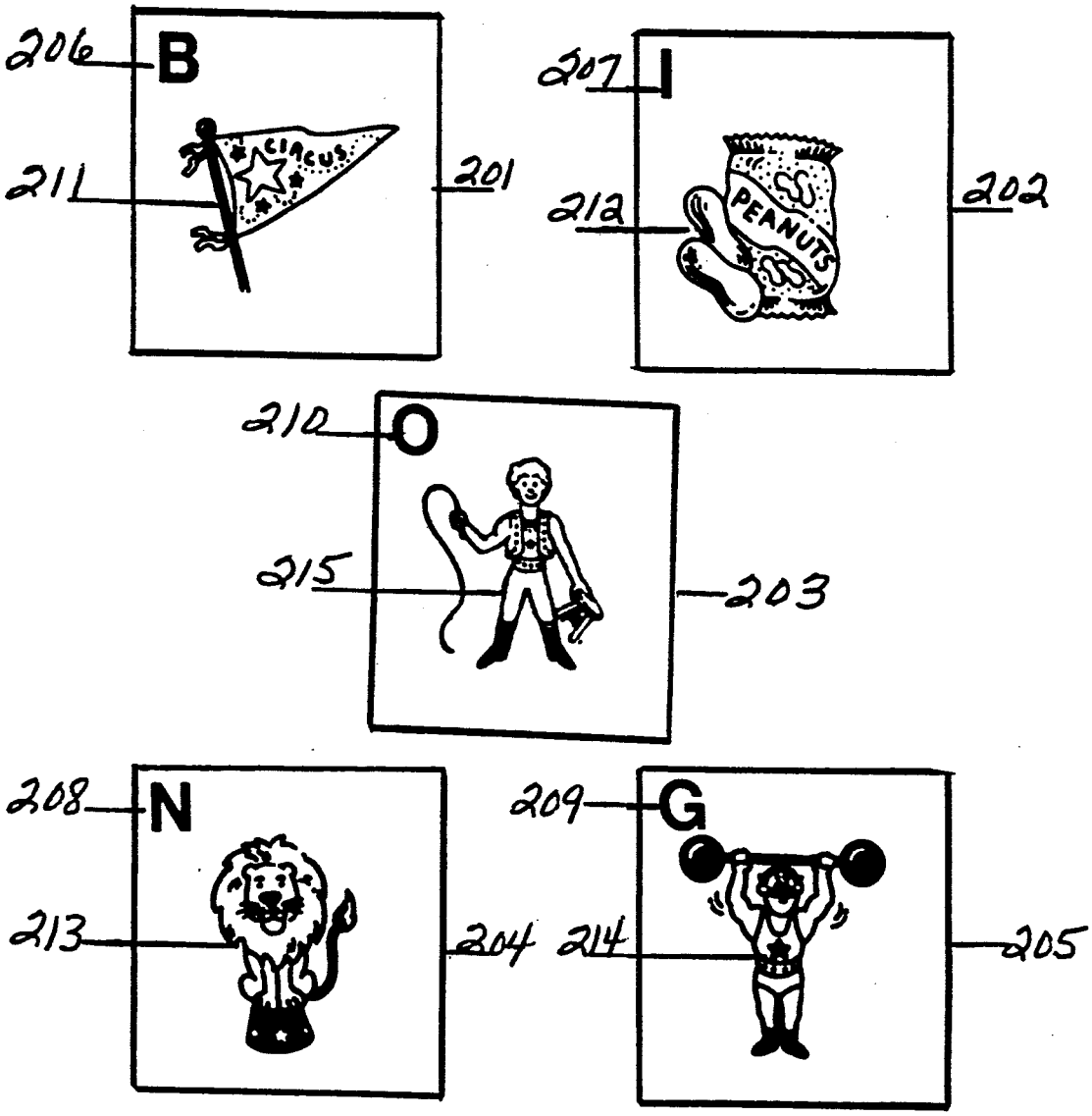
FIG. 2 illustrates typical random selection squares of the "BIG TOP" edition for use with the matching typical player game card of the "BIG TOP" edition shown in FIG. 1.

There are shown in FIG. 2 five typical random selection squares 201 202 203 204 205 employed in the play of the game. As illustrated, each random selection square 201 through 205 contains one letter from the word "BINGO", a "B" 206, or an "I" 207, or an "N" 208, or a "G" 209, or an "O" 210. Additionally, each random selection square 201 through 205 contains one predetermined indicium 211 through 215, each of which reflects the theme of the game in the particular "Edition" being played, here illustrated as BIG TOP 107. An indicium 211 through 215 through 215 once used in combination with a letter 206 through 210 is never repeated with the result that the combination of indicium and its related letter becomes unique. By way of illustration, the indicium, "LION" 213, having been used in combination with the letter "N" 208 may not be used nor found in use with any other letter 206 207 209 210. In the play of the game, thirty different indicia 211 through 215 and a variable number of indicia 401 501 bearing players' names 402 502 are employed and are randomly selected, one at a time, and called by the caller until one or more players become winners. While play is in progress, the selection squares 201 through 205 401 501 selected are set aside by the caller to be used for later verification of a player's claim to having won.

Figure 3:
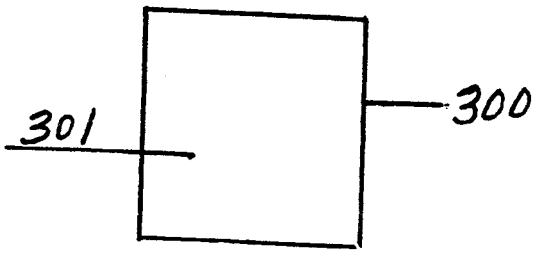
FIG. 3 illustrates a blank random selection square for use with the "BIG TOP" edition and all other "Editions".

There is shown in FIG. 3 a blank random square 300 having its interior area 301 blank. In the play of the game, from a supply of blank random selection squares 300, the caller inserts each player's name on one square 300 in the blank area 301.

Figure 4:
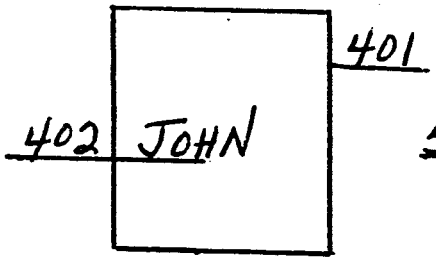
FIG. 4 and FIG. 5 illustrate typical random selection squares which were once blank, FIG. 3, but on which the players' names "John" and "Mary", respectively, have been written prior to the start of play.
Figure 5:
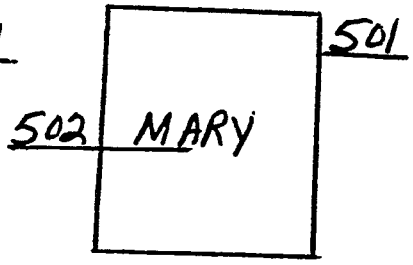

FIG. 4 and FIG. 5 are random selection squares 401 501 which were once blank 301 but which now bear the names of players "John" 402 and "Mary" 502 which the caller has inserted in the blank interior areas 301. Each player's name is inserted on one selection square 401 501. In the play of the game all random selection squares 401 501 on which players' names have been inserted 402 502 are added to the predetermined thematic random selection squares 201 through 205 to be used for random selection, calling, and winner verification.

Figure 6:
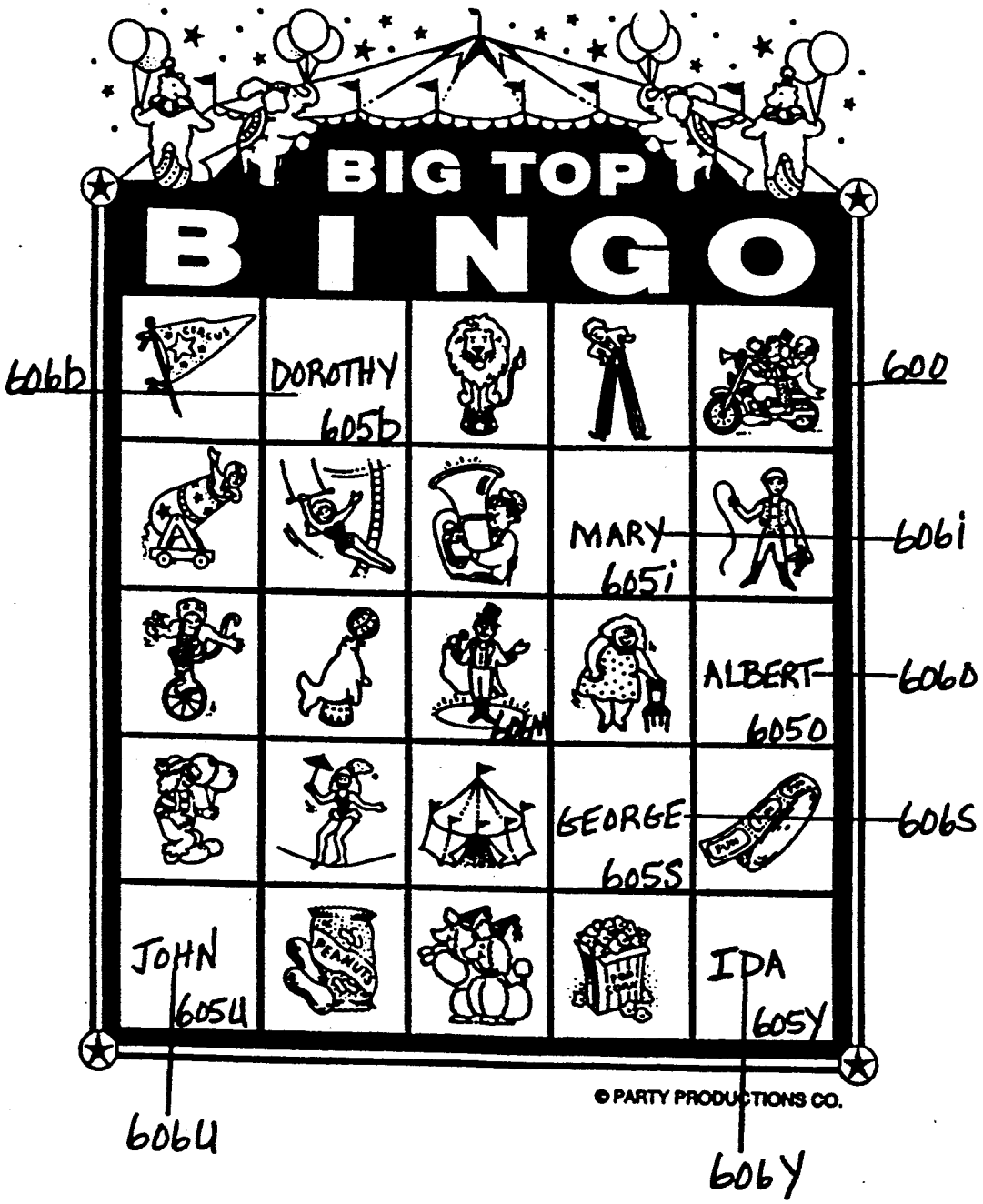
FIG. 6 illustrates a typical player game card of the "BIG TOP" edition which once contained 6 blank areas, FIG. 1, in which the names of the players of the game have been inserted prior to the start of play.

FIG. 6 illustrates a player game card 600 with previously blank squares 105*u* 105*b* 105*i* 105*s* 105*o* 105*y* filled in with players' names 606*u* 606*b* 606*i* 606*s* 606*o* and 606*y*.

Figure 7:
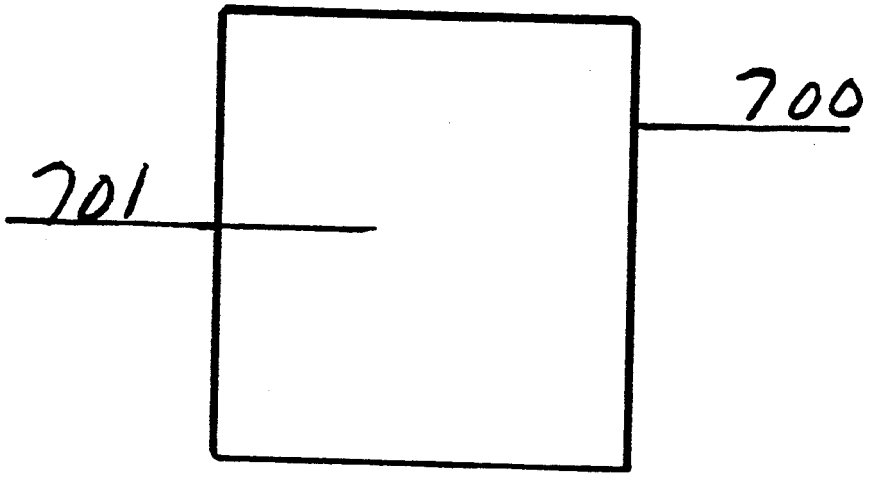
FIG. 7 illustrates a blank marker disc selected and used by a player to identify, by placement on his player game card, a called indicia or player name.

FIG. 7 illustrates a player marker square 700 which is blank 701. Each player controls and uses a supply of no more than twenty five marker squares 700. To begin the play of the game, each player is entitled to cover the center square 606*m* with a marker 700 as a free unannounced covered square. To continue the play of the game, the caller randomly selects a random selection square 201 through 205 401 501 and announces the square letter 206 through 209 403 503 and indicium 211 through 215 402 502. Each player whose player game card 600 carries a matching square 605*a* through 605*y* is entitled to cover it with a marker square 700 800.

As is the case with Bingo type games, the first player to cover five squares 605*a* through 605*y* with markers 700 aligned in a straight line, vertically, horizontally, or diagonally, become a winner. It is possible that two or more players may become simultaneous winners.

Although, for illustrative purposes, my invention and the preferred embodiments are herein described and shown in what is conceived to be the BIG TOP "Edition", it is obvious that many modifications and variations of my invention are possible in the light of the foregoing. It is therefore recognized and understood that within the scope of the invention and appended claims, the invention may be practiced otherwise than as specifically described.

What is claimed and desired to be secured by letters patent is:

1. A children's "bingo" type game for use in developing and enhancing psychological growth and well-being by utilizing the playing children's names as an integral part of the game, comprising:

(a) a plurality of player game cards, each card different from all others and each card including thereon a combination of i) no more than twenty predetermined indicia from a total of thirty predetermined indicia related to or associated with a single subject normally employed by children in an informal atmosphere, and ii) five or more undesignated blank areas in which the playing children insert their own names and the names of other players thereby causing the names so inserted to become additional indicia of the game without a columnar location, and to cause the entire card to be filled with a total of twenty five indicia; and (b) a plurality of selection discs, squares, chips, or other devices, each different from each other, and each identifying a single predetermined indicia and its columnar location on the player game cards described in (a) above; and (c) a plurality of selection discs, squares, chips, or other devices, or the same shape, size, and composition as the ones described in (b) above, with the exception that all are blank and are used to record the name of each player without any columnar location identified thereon; and (d) a plurality of suitable markers of any type selected by the players which are used in the play of the game by the players to cover areas on their game cards which match those identified by random selection and announcement from among the entire group of items described in (b) above in their columnar locations and (c) above whatever their columnar location; and (e) at least one writing implement for writing indicia on the blank card areas and blank selection devices.

2. The game as set forth in claim 1 wherein the said areas of the player game cards are delineated by a grid comprised of twenty five closed plane geometric shapes.

3. The game as set forth in claim 1 wherein the said predetermined indicia are related to the subject of birthdays and are used in combination with the players' names.

4. The game as set forth in claim 1 wherein: the said predetermined indicia are related to the subject of holidays in general or to a particular holiday and are used in combination with the players' names.

5. The game as set forth in claim 1 wherein the said predetermined indicia are related to the subject of the circus and are used in combination with the players' names.

6. The game as set forth in claim 1 wherein the said predetermined indicia are related to the subject of sports in general or to a particular sport and are used in combination with the players' names.

7. The game as set forth in claim 1 wherein the said predetermined indicia are related to the subject of camping and are used in combination with the players' names.

* * * * *